US010094552B2

(12) United States Patent
Lin

(10) Patent No.: US 10,094,552 B2
(45) Date of Patent: Oct. 9, 2018

(54) MULTISTAGE BOILER HEAT EXCHANGE APPARATUS

(71) Applicant: SUNCUE COMPANY LTD., Taichung (TW)

(72) Inventor: Jung-Lang Lin, Taichung (TW)

(73) Assignee: Suncue Company Ltd, Taichung (TW)

( * ) Notice: Subject to any disclaimer, the term of this patent is extended or adjusted under 35 U.S.C. 154(b) by 28 days.

(21) Appl. No.: 15/335,575

(22) Filed: Oct. 27, 2016

(65) Prior Publication Data

US 2018/0119945 A1 May 3, 2018

(51) Int. Cl.

| | |
|---|---|
| ***C02F 9/00*** | (2006.01) |
| ***F22B 1/16*** | (2006.01) |
| ***F22B 33/02*** | (2006.01) |
| ***F22D 1/38*** | (2006.01) |

(52) U.S. Cl.

CPC ..... *F22B 1/16* (2013.01); *F22B 33/02* (2013.01); *F22D 1/38* (2013.01)

(58) Field of Classification Search

CPC ..... C10J 3/721; C10J 3/86; F23J 2900/01002; F01K 13/00; F22B 31/08; F27D 17/004; C02F 9/00

See application file for complete search history.

(56) References Cited

U.S. PATENT DOCUMENTS

| | | | | |
|---|---|---|---|---|
| 4,676,177 | A * | 6/1987 | Engstrom | C10J 3/54 110/210 |
| 5,370,067 | A * | 12/1994 | Finet | B09B 3/005 110/165 A |
| 5,725,614 | A * | 3/1998 | Hirayama | C10J 3/503 110/229 |
| 5,988,080 | A * | 11/1999 | Miyoshi | F01K 23/067 110/216 |
| 8,124,036 | B1 * | 2/2012 | Baldrey | C01G 13/04 423/107 |
| 2014/0196873 | A1 * | 7/2014 | Weber | F23J 3/023 165/121 |

* cited by examiner

*Primary Examiner* — Gregory A Wilson
(74) *Attorney, Agent, or Firm* — C. G. Mersereau; Nikolai & Mersereau, P.A.

(57) ABSTRACT

A multistage boiler heat exchange apparatus has a combustion furnace and at least one boiler set. The combustion furnace is used to produce a heat source and has a furnace base and a hot-air passage. The at least one boiler set is connected to the combustion furnace, and each has a preheater and a boiler. The preheater is deposited adjacent to the combustion furnace, and is connected to and communicates with the hot-air passage to adjust temperature of the heat source that enters the preheater. The boiler is an uprightly-deposited cylinder, is connected to the preheater, and has a conducting pipe and an exchange tube. The conducting pipe is deposited on and communicates with the boiler to enable the heat source to enter the boiler. The exchange tube is deposited in the boiler and has an exchange medium to exchange heat with the heat source in the boiler.

19 Claims, 4 Drawing Sheets

MULTISTAGE BOILER HEAT EXCHANGE APPARATUS

BACKGROUND OF THE INVENTION

1. Field of the Invention

The present invention relates to a boiler heat exchange apparatus, and more particularly to a multistage boiler heat exchange apparatus that may improve the combustion efficiency, may increase the service life, and reduce the cost of using the multistage boiler heat exchange apparatus.

2. Description of Related Art

Conventional boiler heat exchange apparatuses have been widely used in the industrial processes, and can be used for cooling, heating or recovering of waste heat. The conventional boiler heat exchange apparatus has a combustion furnace and a boiler. The combustion furnace may generate heat source after burning fuels, and the boiler is connected to the combustion furnace to receive the heat source that is generated in the combustion furnace for heat exchanging. The boiler of the conventional boiler heat exchange apparatus is a single coil tube boiler and is deposited horizontally, and the heat that is generated from the combustion furnace may heat liquid or gas within the coil tube boiler to produce hot water, steam or other media of exchange.

Though the conventional boiler heat exchange apparatus may provide a heat-exchanging effect, the temperature of the heat source that is generated from the combustion furnace is high and may directly damage the tubes of the coil tube boiler, and this may reduce the service life of the coil tube boiler. In addition, due to the high temperature of the heat source, the pipes that are used to transport gas of the heat source may be made of refractory materials, and this may increase the cost of use and cause heat loss. Furthermore, since the coil tube boiler is deposited horizontally and the ashes that are produced after burning may be accumulated in the coil tube boiler easily, which causes blocking. Therefore, in use, the conventional boiler heat exchange apparatus must be stopped regularly to clean the tubes of the coil tube boiler, and this may increase the cost of use.

To overcome the shortcomings, the present invention provides a multistage boiler heat exchange apparatus to mitigate or obviate the aforementioned problems.

SUMMARY OF THE INVENTION

The main objective of the present invention is to provide a boiler heat exchange apparatus, and more particularly to a multistage boiler heat exchange apparatus that may improve the combustion efficiency, may increase the service life, and reduce the cost of using the multistage boiler heat exchange apparatus.

The multistage boiler heat exchange apparatus in accordance with the present invention has a combustion furnace and at least one boiler set. The combustion furnace is used to produce a heat source by burning fuels and has a furnace base and a hot-air passage. The furnace is deposited on a bottom of the combustion furnace, and the hot-air passage is deposited on a top of the combustion furnace. The at least one boiler set is connected to the combustion furnace, and each has a preheater and a boiler. The preheater is deposited adjacent to the combustion furnace, and is connected to and communicates with the hot-air passage to adjust temperature of the heat source that enters the preheater. The boiler is an uprightly-deposited cylinder, is connected to the preheater, and has a conducting pipe and an exchange tube. The conducting pipe is deposited on and communicates with the boiler to enable the heat source to enter the boiler via the preheater. The exchange tube is deposited in the boiler and has an exchange medium to exchange heat with the heat source that enters the boiler.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
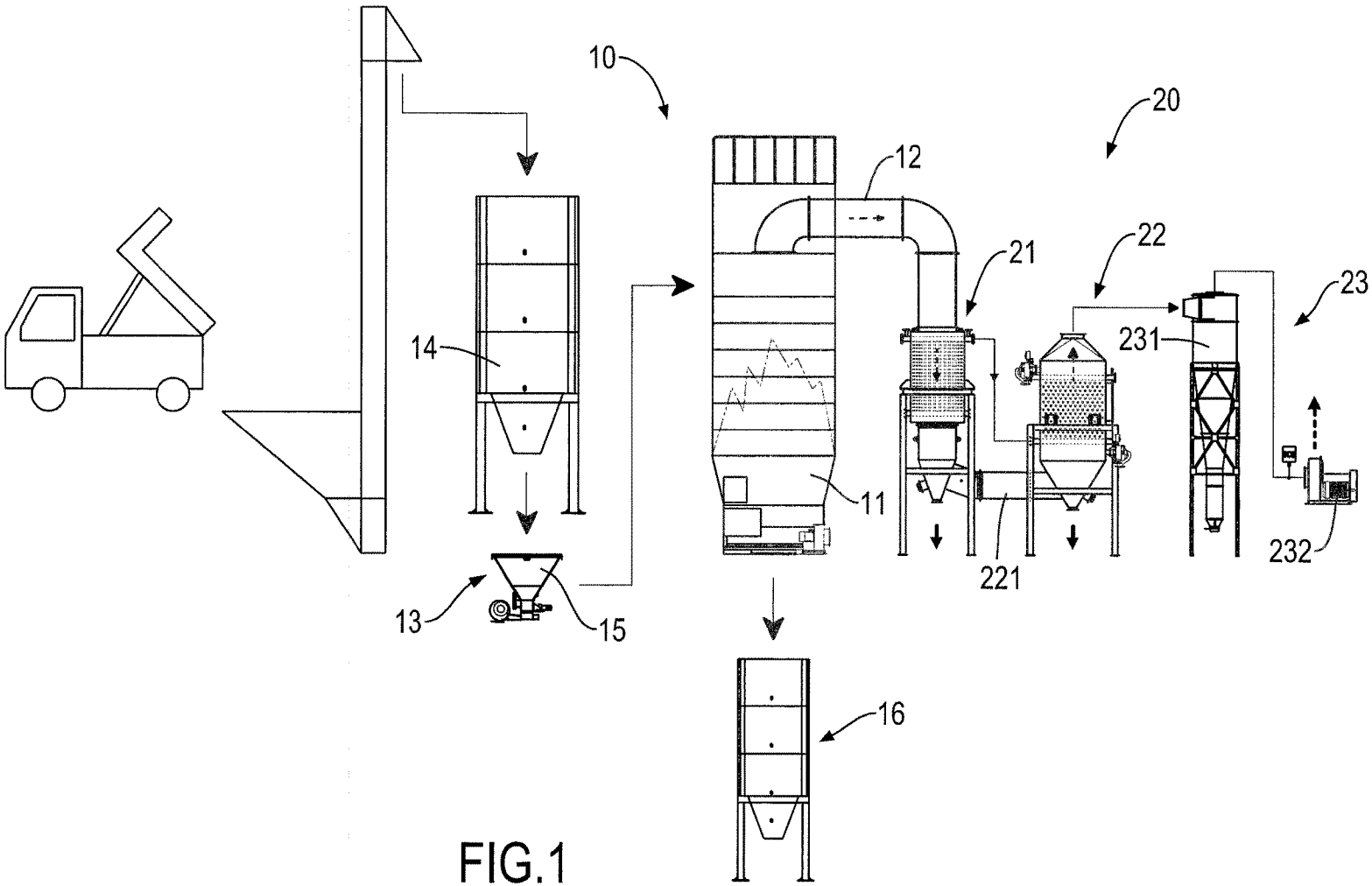
FIG. 1 is a perspective side view of a multistage boiler heat exchange apparatus in accordance with the present invention.
Figure 2:
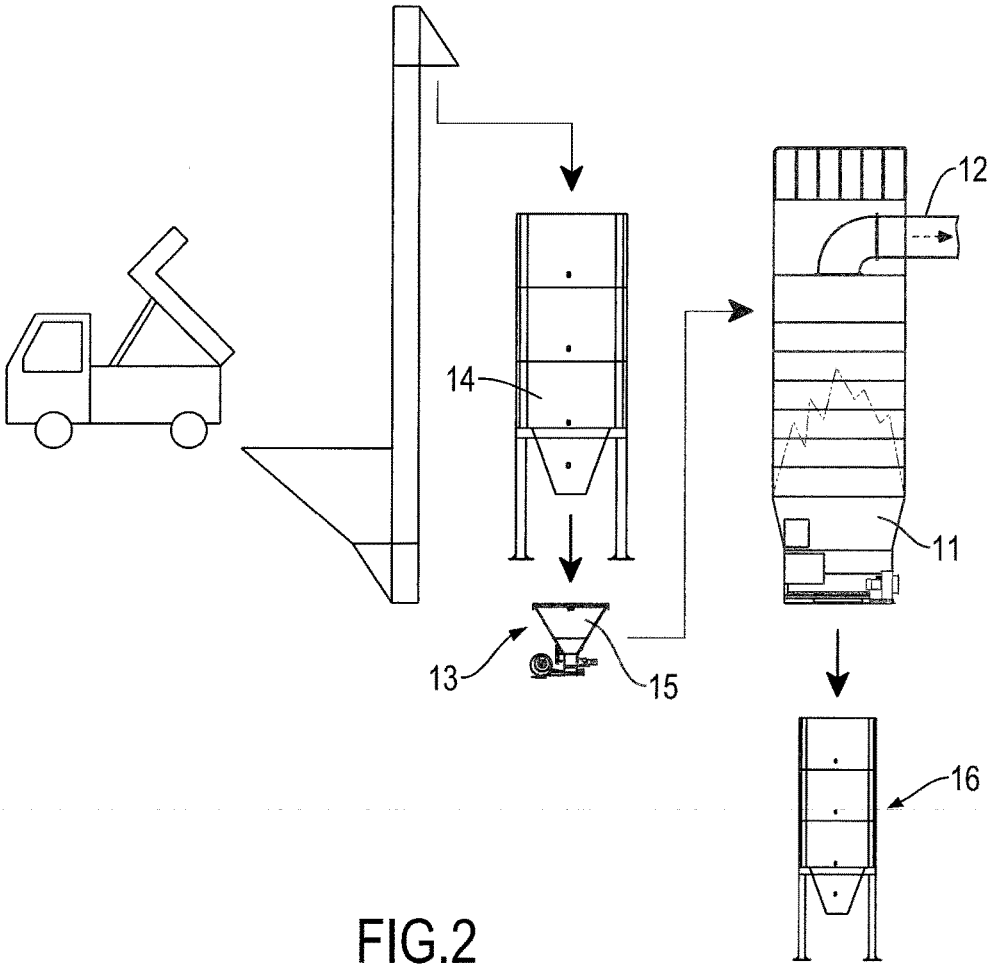
FIG. 2 is an enlarged perspective side view of the multistage boiler heat exchange apparatus in FIG. 1.
Figure 3:
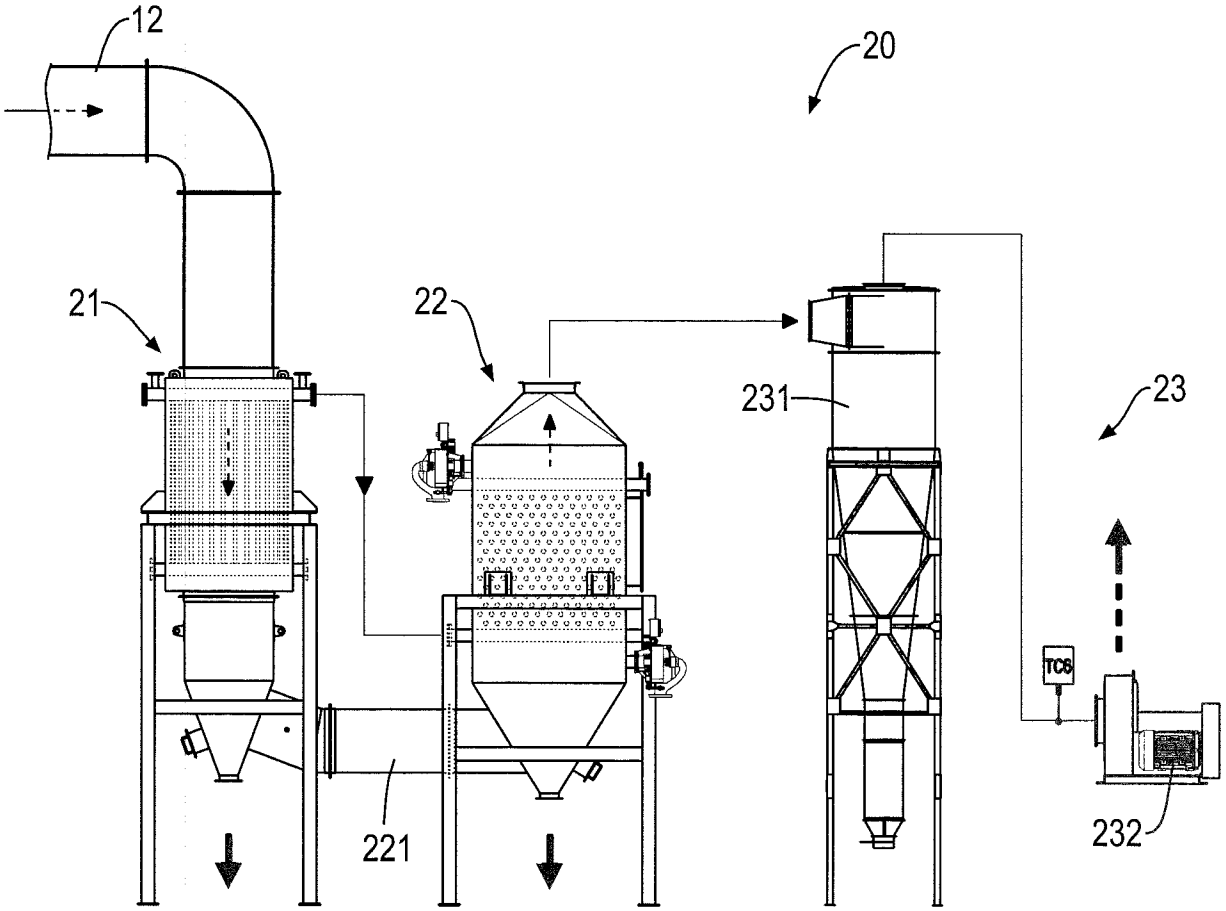
FIG. 3 is another enlarged perspective side view of the multistage boiler heat exchange apparatus in FIG. 1.

With reference to FIGS. 1 to 3, a multistage boiler heat exchange apparatus in accordance with the present invention has a combustion furnace 10 and at least one boiler set 20.

The combustion furnace 10 is deposited uprightly, is used to produce a heat source by burning fuels, and has a bottom, a top, a furnace base 11, a hot-air passage 12, a delivery unit 13, and an ash tank 16. The furnace base 11 is deposited on the bottom of the combustion furnace 10. The hot-air passage 12 is deposited on the top of the combustion furnace 10. The delivery unit 13 is deposited beside the combustion furnace 10, is used to store fuel, and has a storage tank 14 and a transporting seat 15. The storage tank 14 is deposited beside the combustion furnace 10 and is used to store husks that are shelled from grains and can be used as biomass fuels, and the grains are, for example, rice, wheat or coffee beans. The transporting seat 15 is mounted below the storage tank 14, is connected to the combustion furnace 10, and is used to transport the biomass fuels from the storage tank 14 to the combustion furnace 10.

Furthermore, a connection relationship between the storage tank 14, the transporting seat 15, and the combustion furnace 10 is conventional and the features and the structures of the connection relationship are not described in detail. Ashes that are generated by the biomass fuels burning in the combustion furnace or the biomass fuels that are incompletely burned may accumulate on the furnace base 11 of the combustion furnace 10 at the same time. The ash tank 16 is deposited beside the combustion furnace 10 and is used to store the ashes that are generated in the combustion furnace 10.

The at least one boiler set 20 is connected to the combustion furnace 10, and each one of the at least one boiler set 20 has a preheater 21, a boiler 22 connected to the preheater 21, and a chimney pipe group 23. The preheater 21 is deposited adjacent to the combustion furnace 10 and is connected to and communicates with the hot-air passage 12. Furthermore, the temperature of the heat source that enters the preheater 21 can be adjusted by the preheater 21, and this may prevent the excessive temperatures of the heat source from directly entering and damaging the boiler 22. Additionally, the preheater 21 prevents the excessive temperature of the heat source from damaging the boiler 22, this may increase the service life of the boiler 22 and does not require using a refractory material to make the boiler 22, and this may reduce the cost of use and may increase the heat exchange efficiency of the boiler 22.

Further, the boiler 22 has a bottom, a top, an external surface, a conducting pipe 221, and an exchange tube. The conducting pipe 221 is deposited on the external surface of the boiler 22 adjacent to the bottom of the boiler 22, and communicates with the boiler 22 to enable the heat source that is generated from the combustion furnace 10 to enter the boiler 22 via the preheater 21 and the conducting pipe 221. The exchange tube is deposited in the boiler 22 and has an exchange medium to exchange heat with the heat source that enters the boiler 22. Furthermore, the exchange tube may be a vertically disposed coil exchanger tube.

Figure 4:
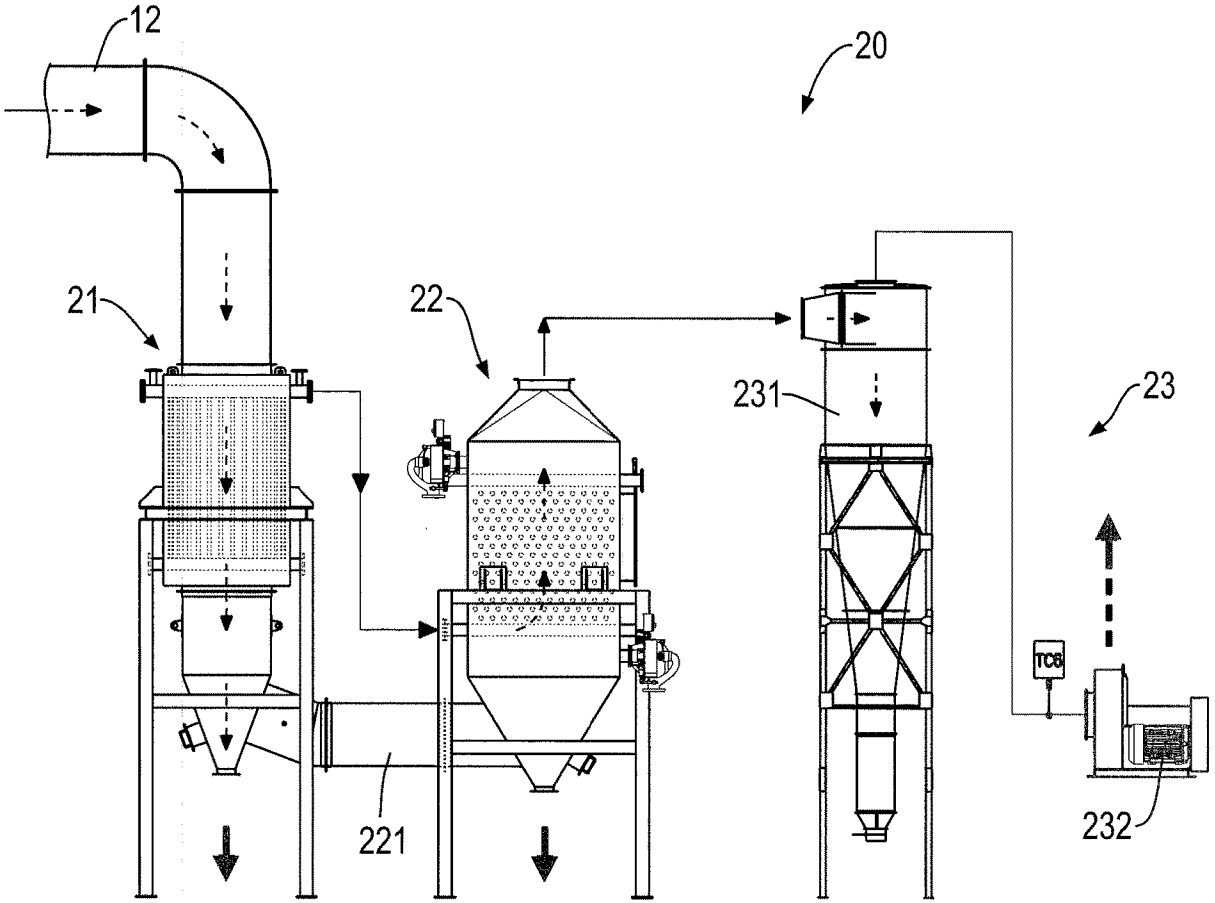
FIG. 4 is an enlarged and operational perspective side view of the multistage boiler heat exchange apparatus in FIG. 1.

With reference to FIG. 4, the conducting pipe 221 is deposited adjacent to the bottom of the boiler 22 and the boiler 22 is an uprightly-deposited cylinder. Then, when the heat source enters the boiler 22 via the conducting pipe 221, the flowing direction of the heat source will be changed, and the ashes can be released from the heat source when the flowing direction of the heat source is changed (release by change of the flowing direction). In addition, the boiler 22 is set uprightly and may reduce the flowing speed of the heat source that enters the boiler 22. When the flowing speed of the heat source is reduced, the ashes that enter the boiler 22 cannot be carried by the heat source and may be released from the heat source (release by reduction of the flowing speed). Consequently, the ashes do not accumulate in the boiler 22 and an ash collecting device is not needed to deposit on the boiler 22, and this may reduce the cost of using the at least one boiler set 20. Additionally, the boiler 22 is a steam boiler or a hot water boiler.

With further reference to FIGS. 1 and 3, the chimney pipe group 23 of each one of the at least one boiler set 20 is connected to the boiler 22 and has a top, a cyclone ash collector 231, and an exhaust fan 232. The cyclone ash collector 231 is connected to and communicates with the top of the boiler 22 to guide the heat source and the fuel gas after heat exchanging to flow out of the boiler 22, and this may prevent excessive pressure within the boiler 22 from causing danger. The exhaust fan 232 is connected to the cyclone ash collector 231 and is used to discharge the heat source and the fuel gas that flow to the cyclone ash collector 231 out of the at least one boiler set 20, may achieve an effect of discharging hot gas and introducing cold air, and may increase the safety factor of using the multistage boiler heat exchange apparatus in the present invention.

With reference to FIGS. 1 and 4, when the multistage boiler heat exchange apparatus is in use, the biomass fuels that are stored in the storage tank 14 are transported into the combustion furnace 10 via the transporting seat 15 of the delivery unit 13, and the biomass fuels are burned in the combustion furnace 10 to generate a heat source and ashes. The heat source enters the preheater 21 via the hot-air passage 12, and the ashes are accumulated on the furnace base 11 and are collected in the ash tank 16. The preheater 21 may adjust the temperature of the heat source and this may prevent the excessive temperature of the heat source from directly entering the boiler 22 to damage the boiler 22. Consequently, this may increase the service life of the boiler 22 and does not require using a refractory material to make the boiler 22, and reduce the cost of use and may increase the heat exchange efficiency of the boiler 22.

With further to FIG. 4, since the conducting pipe 221 is deposited adjacent to the bottom of the boiler 22 and the boiler 22 is an uprightly-deposited cylinder, when the heat source enters the boiler 22 via the conducting pipe 221, the flowing direction of the heat source will be changed, and the ashes can be released from the heat source when the flowing direction of the heat source is changed (release by change of the flowing direction). In addition, the boiler 22 is set uprightly and may reduce the flowing speed of the heat source that enters the boiler 22. When the flowing speed of the heat source is reduced, the ashes that enter the boiler 22 but cannot be carried by the heat source may be released from the heat source (release by reduction of the flowing speed). Consequently, the ashes do not accumulate in the boiler 22 and an ash collecting device is not needed to deposit on the boiler 22, and this may reduce the cost of using the at least one boiler set 20.

According to the above-mentioned structural relationships and features of the multistage boiler heat exchange apparatus, the multistage boiler heat exchange apparatus in the present invention has the following advantages.

1. The preheater 21 is deposited between the boiler 22 and the combustion furnace 10 to provide a buffering effect to the temperature of the heat source, and this may prevent the excessive temperatures of the heat source that is generated by burning the biomass fuels from directly damaging the boiler 22, and the boiler 22 of each one of the at least one boiler set 20 does not require using the refractory material to make the boiler 22, and the heat exchange efficiency and the combustion efficiency of the multistage boiler heat exchange apparatus can be improved.

2. The at least one boiler set 20 has the preheater 21 and the boiler 22 to provide a multistage structure, and this may prevent the excessive temperature of the heat source that is generated in the combustion furnace 10 from directly heating the exchange tube in the boiler 22, and this may avoid the excessive temperature damaging the exchange tube and increase the service life of the exchange tube and the boiler 22.

3. When the multistage boiler heat exchange apparatus is in use, the preheater 21 that is deposited between the combustion furnace 10 and the boiler 22 may provide a buffering and preheating effect to the temperature of the heat source. Then, the boiler 22 of the at least one boiler set 20 does not require using the refractory material to make the boiler 22, and this may reduce the cost of using the multistage boiler heat exchange apparatus. Additionally, the conducting pipe 221 is deposited adjacent to the bottom of the boiler 22 and the boiler 22 is an uprightly-deposited cylinder, the flowing direction of the heat source will be changed when the heat source enters the boiler 22 via the preheater 21, and this may enable the ashes to release from the heat source (release by change of the flowing direction). Furthermore, the boiler 22 is set uprightly and may reduce the flowing speed of the heat source that enters the boiler 22, and this may also enable the ashes to release from the heat source (release by reduction of the flowing speed). Therefore, the ashes do not accumulate in the boiler 22 and an ash collecting device is not needed to deposit on the boiler 22, and this may reduce the cost of using the at least one boiler set 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multistage boiler heat exchange apparatus comprising:

a combustion furnace being used to produce a heat source by burning fuels, and having a bottom;

a top;

a furnace base deposited on the bottom of the combustion furnace; and a hot-air passage deposited on the top of the combustion furnace; and at least one boiler set connected to the combustion furnace, and each one of the at least one boiler set having a preheater deposited adjacent to the combustion furnace, connected to and communicating with the hot-air passage of the combustion furnace to adjust temperature of the heat source that enters the preheater; and a boiler being an uprightly-deposited cylinder, connected to the preheater, and having a bottom;

a top;

an external surface;

a conducting pipe deposited on the external surface of the boiler adjacent to the bottom of the boiler, communicating with the boiler to enable the heat source that is generated from the combustion furnace to enter the boiler via the preheater and the conducting pipe; and an exchange tube deposited in the boiler and having an exchange medium to exchange heat with the heat source that enters the boiler;

wherein a relative structural relationship between the preheater, the boiler, and the connecting pipe enables a flowing direction of a heat source to be changed when the heat source enters the boiler from the preheater via the connecting pipe to release ashes from the heat source, and enables a flowing speed of the heat source to be reduced when the heat source enters the uprightly-deposited boiler to release ashes from the heat source.

2. The multistage boiler heat exchange apparatus as claimed in claim 1, wherein the combustion furnace has a delivery unit deposited beside the combustion furnace to store fuels, and the delivery unit has a storage tank deposited beside the combustion furnace to store the fuels; and a transporting seat mounted below the storage tank and connected to the combustion furnace to transport the fuels from the storage tank to the combustion furnace.

3. The multistage boiler heat exchange apparatus as claimed in claim 2, wherein the combustion furnace has an ash tank deposited beside the combustion furnace to store ashes that are generated in the combustion furnace by burning the fuels.

4. The multistage boiler heat exchange apparatus as claimed in claim 3, wherein each one of the at least one boiler set has a chimney pipe group, and the chimney pipe group is connected to the boiler of the at least one boiler set and has a top;

a cyclone ash collector connected to and communicating with the top of the boiler to guide the heat source and the fuel gas after heat exchanging to flow out of the boiler; and an exhaust fan connected to the cyclone ash collector to discharge the heat source and fuel gas that flow to the cyclone ash collector out of the at least one boiler set.

5. The multistage boiler heat exchange apparatus as claimed in claim 4, wherein the exchange tube of the boiler of each one of the at least one boiler set is a vertically disposed coil exchange tube.

6. The multistage boiler heat exchange apparatus as claimed in claim 4, wherein the boiler of each one of the at least one boiler set is a steam boiler.

7. The multistage boiler heat exchange apparatus as claimed in claim 4, wherein the boiler of each one of the at least one boiler set is a hot water boiler.

8. The multistage boiler heat exchange apparatus as claimed in claim 3, wherein the exchange tube of the boiler of each one of the at least one boiler set is a vertically disposed coil exchanger tube.

9. The multistage boiler heat exchange apparatus as claimed in claim 3, wherein the boiler of each one of the at least one boiler set is a steam boiler.

10. The multistage boiler heat exchange apparatus as claimed in claim 3, wherein the boiler of each one of the at least one boiler set is a hot water boiler.

11. The multistage boiler heat exchange apparatus as claimed in claim 2, wherein the exchange tube of the boiler of each one of the at least one boiler set is a vertically disposed coil exchanger tube.

12. The multistage boiler heat exchange apparatus as claimed in claim 2, wherein the boiler of each one of the at least one boiler set is a steam boiler.

13. The multistage boiler heat exchange apparatus as claimed in claim 2, wherein the boiler of each one of the at least one boiler set is a hot water boiler.

14. The multistage boiler heat exchange apparatus as claimed in claim 2, wherein each one of the at least one boiler set has a chimney pipe group, and the chimney pipe group is connected to the boiler of the at least one boiler set and has a top;

a cyclone ash collector connected to and communicating with the top of the boiler to guide the heat source and fuel gas after heat exchanging to flow out of the boiler; and an exhaust fan connected to the cyclone ash collector to discharge the heat source and fuel gas that flow to the cyclone ash collector out of the at least one boiler set.

15. The multistage boiler heat exchange apparatus as claimed in claim 1, wherein the exchange tube of the boiler of each one of the at least one boiler set is a vertically disposed coil exchanger tube.

16. The multistage boiler heat exchange apparatus as claimed in claim 1, wherein the boiler of each one of the at least one boiler set is a steam boiler.

17. The multistage boiler heat exchange apparatus as claimed in claim 1, wherein the boiler of each one of the at least one boiler set is a hot water boiler.

18. The multistage boiler heat exchange apparatus as claimed in claim 1, wherein the combustion furnace has an ash tank deposited beside the combustion furnace to store ashes that are generated in the combustion furnace by burning the fuels.

19. The multistage boiler heat exchange apparatus as claimed in claim 1, wherein each one of the at least one boiler set has a chimney pipe group, and the chimney pipe group is connected to the boiler of the at least one boiler set and has a top;

a cyclone ash collector connected to and communicating with the top of the boiler to guide the heat source and fuel gas after heat exchanging to flow out of the boiler; and an exhaust fan connected to the cyclone ash collector to discharge the heat source and fuel gas that flow to the cyclone ash collector out of the at least one boiler set.

* * * * *